US011211754B2

(12) United States Patent
Zhu

(10) Patent No.: US 11,211,754 B2
(45) Date of Patent: Dec. 28, 2021

(54) SWITCH DEVICE

(71) Applicant: Gong Zhu, Xiamen (CN)

(72) Inventor: Gong Zhu, Xiamen (CN)

( * ) Notice: Subject to any disclaimer, the term of this patent is extended or adjusted under 35 U.S.C. 154(b) by 2 days.

(21) Appl. No.: 16/983,032

(22) Filed: Aug. 3, 2020

(65) Prior Publication Data

US 2020/0366040 A1 Nov. 19, 2020

Related U.S. Application Data

(63) Continuation-in-part of application No. 16/442,478, filed on Jun. 15, 2019, now Pat. No. 10,770,849, which is a continuation of application No. 15/920,472, filed on Mar. 14, 2018, now Pat. No. 10,367,316, which is a continuation of application No. 15/602,146, filed on May 23, 2017, now Pat. No. 9,979,148.

(30) Foreign Application Priority Data

May 24, 2016 (CN) ..... 201610352013.4

(51) Int. Cl.

| | |
|---|---|
| ***H01R 25/16*** | (2006.01) |
| ***H01F 27/29*** | (2006.01) |
| ***H01R 25/14*** | (2006.01) |
| ***H01R 4/00*** | (2006.01) |
| ***H01R 4/62*** | (2006.01) |
| ***H01R 4/42*** | (2006.01) |
| ***H01R 11/28*** | (2006.01) |
| ***H01R 4/36*** | (2006.01) |

(52) U.S. Cl.

CPC ..... *H01R 25/162* (2013.01); *H01F 27/29* (2013.01); *H01R 4/42* (2013.01); *H01R 4/54* (2013.01); *H01R 4/62* (2013.01); *H01R 25/145* (2013.01); *H01R 4/36* (2013.01); *H01R 11/28* (2013.01)

(58) Field of Classification Search

CPC ..... H01R 25/162; H01R 4/54; H01R 4/62; H01R 25/145; H01R 4/36; H01R 11/28; H01R 4/42; H01F 27/29

See application file for complete search history.

(56) References Cited

U.S. PATENT DOCUMENTS

| | | | | |
|---|---|---|---|---|
| 9,225,080 | B2 * | 12/2015 | Himeno | H01R 4/302 |
| 9,979,148 | B2 * | 5/2018 | Zhu | H01F 27/29 |
| 10,367,316 | B2 * | 7/2019 | Zhu | H01R 25/162 |
| 10,770,849 | B2 * | 9/2020 | Zhu | H01F 27/29 |

* cited by examiner

*Primary Examiner* — Renee S Luebke
*Assistant Examiner* — Paul D Baillargeon

(57) ABSTRACT

A device has a wiring terminal for connecting a busbar, the wiring terminal has a connecting rod, which partly inserts into the wiring terminal and has an interference fit with the wiring terminal, the connecting rod has a conductive first column portion that has an interference fit with the busbar, the first column portion axially arranges a conductive second column portion that has an interference fit with the first column portion, the second column portion is located inside of the first column portion, a thermal expansion coefficient of the second column portion is greater than that of the first column portion, a resistivity of the second column portion is greater than that of the first column portion, a material of the second column portion is an aluminum or an aluminum alloy, and a material of the first column portion is a copper or a copper alloy.

4 Claims, 8 Drawing Sheets

SWITCH DEVICE

CROSS-REFERENCE TO RELATED APPLICATIONS

This application is a continuation-in-part of U.S. patent application Ser. No. 16/442,478, filed Jun. 15, 2019, which is a continuation of U.S. patent application Ser. No. 15/920,472, filed Mar. 14, 2018, which is a continuation of U.S. patent application Ser. No. 15/602,146, filed May 23, 2017, which claimed priority to China Patent Application No. 2016103520134, filed May 24, 2016, the entire content of related applications are hereby incorporated by reference.

BACKGROUND OF THE INVENTION

The invention relates to an electric device, especially to a switch device.

In the field of power distribution, a switch device is installed in a switch cabinet, a wiring terminal of the switch is usually directly connected with a power busbar, the power busbar is directly overlapped on the wiring terminal, the wiring terminal and the power busbar are commonly connected by an overlapping joint method, and then a bolt and a nut are used for fastening. See FIG. 3 and FIG. 4, as this method required, there is a certain length of a busbar and a wiring terminal needed to overlap for keeping a current density of a touching surface within a normal range of values so as to make the connecting part meet requirements of related standards. In order to keep a low temperature rising of an electric device, usually a length of overlapping is increased for increasing a touching surface so as to reduce a current density thereof. However, increasing the length of overlapping may increase amounts of busbars resulted in increasing cost. Electric clearance or phase distance between busbars may be reduced as a result of bolts used for fastening, in order not to reduce the electric clearance or phase distance, a distance between an wiring terminal and a nonconductive elements needs to be increased, however increasing the distance necessarily enlarge an occupation space of switch device. How to increase a touching surface for reducing a temperature rising not resulted in reducing electric clearance or enlarging occupation space of switch device.

BRIEF SUMMARY OF THE INVENTION

The object of the invention is to provide a switch device so as to solve the above problem. Such object is achieved by providing an electric device as defined in claim 1. Further advantageous according to the invention will be apparent from the dependent claims.

The invention provides an electric device, the electric device comprises a wiring terminal for connecting a busbar, the wiring terminal comprises a connecting rod, which partly inserts into the wiring terminal and has an interference fit with the wiring terminal, the connecting rod comprises a conductive first column portion that has an interference fit with the busbar, the first column portion axially arranges a conductive second column portion that has an interference fit with the first column portion, the second column portion is located inside of the first column portion, a thermal expansion coefficient of the second column portion is greater than that of the first column portion, a resistivity of the second column portion is greater than that of the first column portion, a material of the second column portion is an aluminum or an aluminum alloy, and a material of the first column portion is a copper or a copper alloy.

Advantageous Effects

Since a wiring terminal of an electric device is connected to a busbar via a manner of butt-and-butt connecting, such connecting manner have following advantageous effects compared to a usual manner of overlapping connecting.

1. The same overlapping length with respect to the prior art increases more conductive surface for reducing a current density to achieve low temperature rising of connecting part.
2. No need to overlap a busbar and an output, so amount of material is reduced and save the social source.
3. Because there is no bolts or nuts for fastening, the electric clearance or safety distance is increased, an electric safety of device is also increased.
4. Because there is no bolts or nuts for fastening, a width of connecting part is reduced, an occupation space of a transformer is also reduced.

BRIEF DESCRIPTION OF THE SEVERAL VIEWS OF THE DRAWINGS

Further characteristics and advantages of the invention will emerge from the description of preferred, but not exclusive embodiments of the electric device according to the invention, non-limiting examples of which are provided in the attached drawings, in which.

LIST OF REFERENCE NUMBERS

1. first column portion;
2. second column portion;
3. front surface;
4. rear surface;
5. end surface;
6. first through hole;

7. second through hole;
9. shell;
10. handle.

DETAILED DESCRIPTION OF THE INVENTION

R in this application stands for a radius.

Embodiment 1

Figure 1:
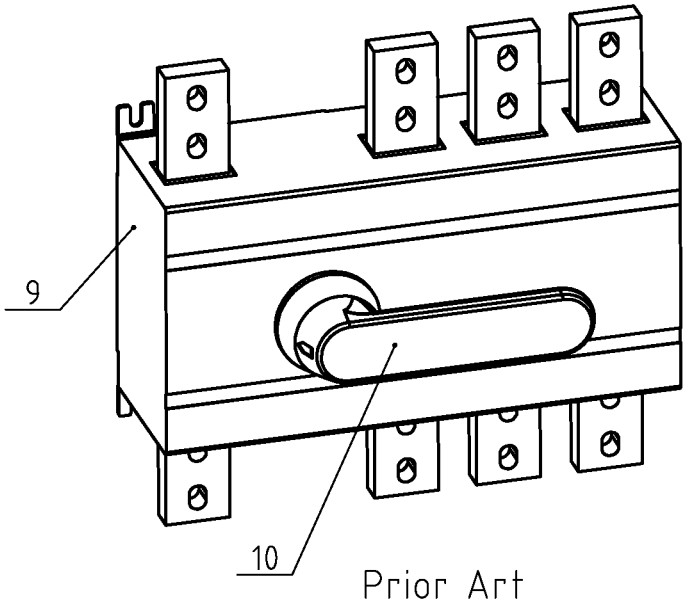
Prior Art Fig.1
FIG. 1 is a 3d-drawing of a traditional switch device showing from front view.
Figure 2:
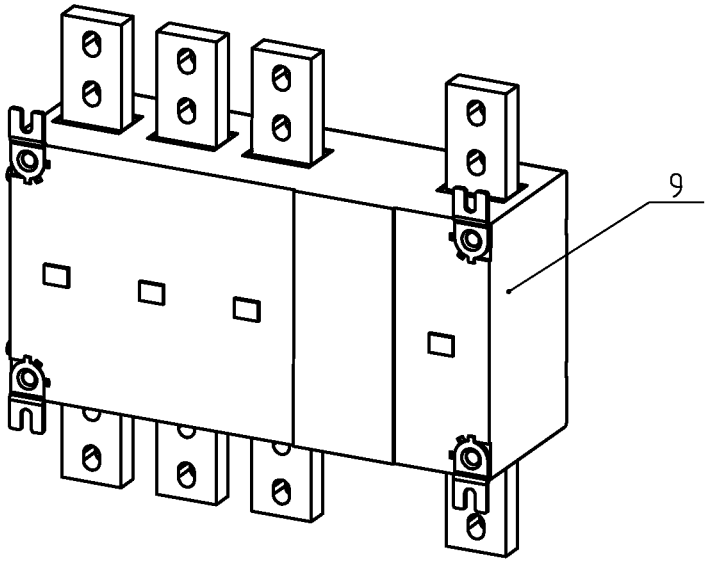
Prior Art Fig.2
FIG. 2 is a 3d-drawing of a traditional switch device showing from back view.

Referring to FIG. 1 and FIG. 2, it shows a traditional switch device, the device comprises four poles and a handle 10 between two poles, each one of four poles comprises two wiring terminals for connecting busbars and a switching unit arranged between the two wiring terminals for connecting or disconnecting the two wiring terminals, the switching unit comprises a movable contact connecting with a first wiring terminal, a stationary contact connecting with a second wiring terminal, and a shell 9 housing the movable contact and the stationary contact, the handle 10 controls a movement of the movable contact, the first wiring terminal and the second wiring terminal partially expose the housing.

Figure 3:
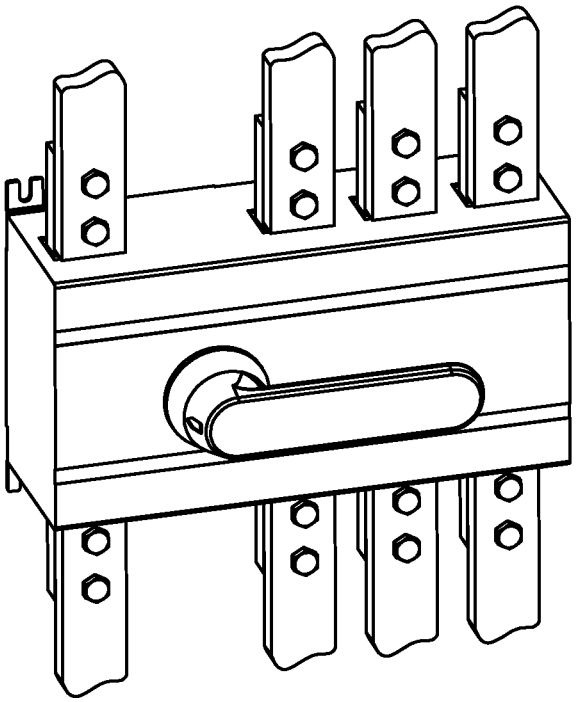
Prior Art Fig.3
FIG. 3 is a 3d-drawing of a traditional switch device showing from front view, wherein busbars are connected.
Figure 4:
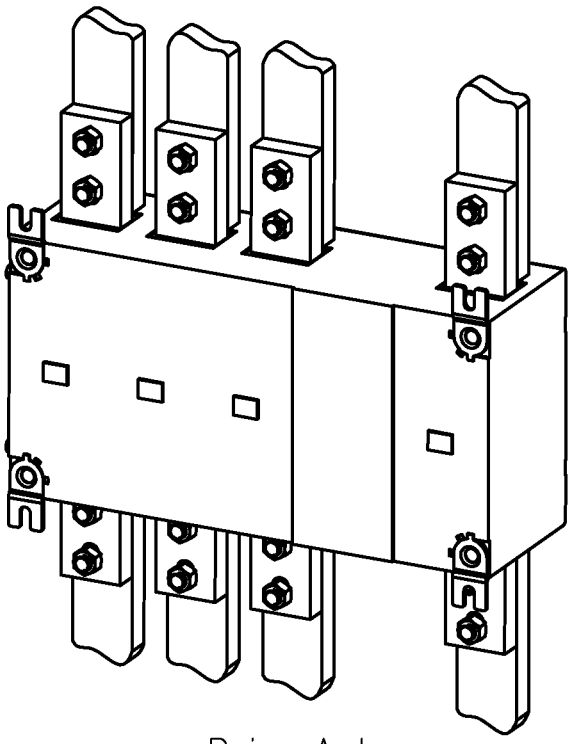
Prior Art Fig.4
FIG. 4 is a 3d-drawing of a traditional switch device showing from back view, wherein busbars are connected.

Referring to FIG. 3 and FIG. 4, it shows a connecting method between the wiring terminal of the traditional switch device and the busbars, an overlapping connecting method is applied, partly overlapping the wiring terminal and the busbar and then fastening them via bolts and nuts, such connecting manner is called overlapping connecting.

Figure 5:
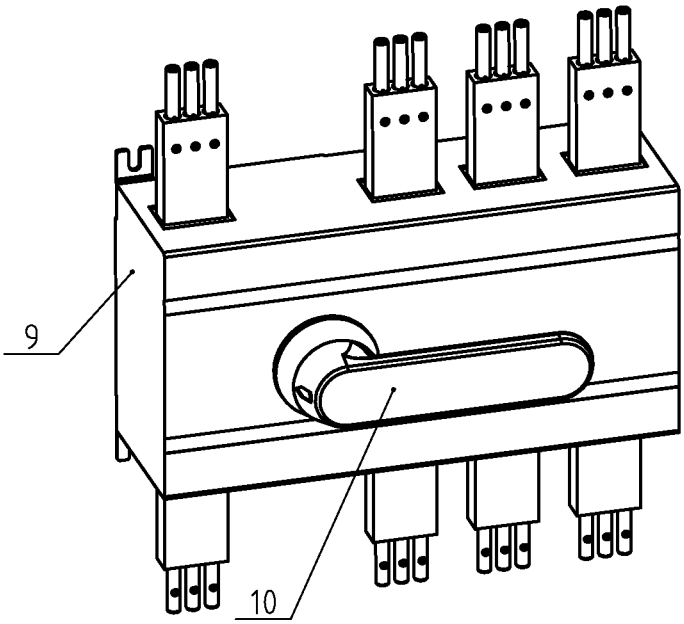
FIG. 5 is a 3d-drawing of a switch device of the invention showing from front view.
Figure 6:
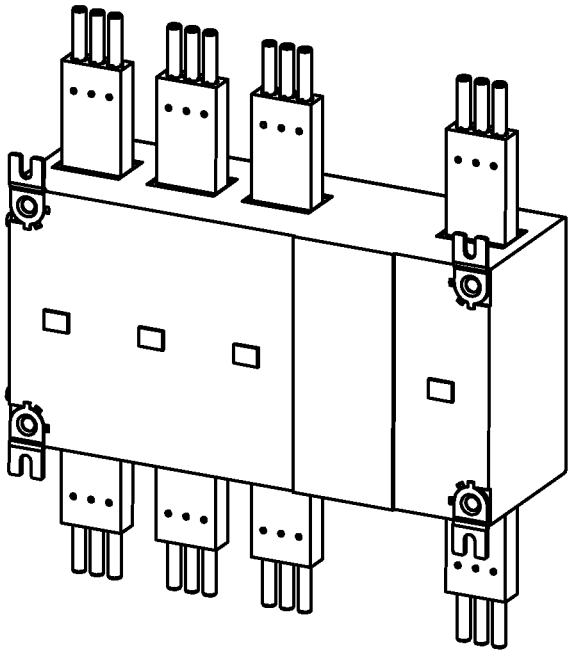
FIG. 6 is a 3d-drawing of a switch device of the invention showing from back view.
Figure 17:
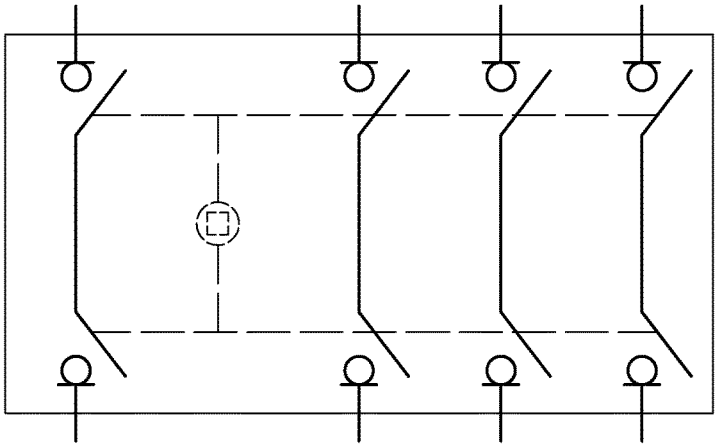
Prior Art Fig.17
FIG. 17 is an electrical schematic diagram of a switch device.

Referring to FIG. 5 and FIG. 6, it shows a switch device of the invention, the switch device comprises four poles and a handle 10 between two poles, each one of four poles comprises two wiring terminals for connecting busbars and a switching unit arranged between the two wiring terminals for connecting or disconnecting the two wiring terminals, the switching unit comprises a movable contact connecting with a first wiring terminal, a stationary contact connecting with a second wiring terminal, and a shell 9 housing the movable contact and the stationary contact, the first wiring terminal and the second wiring terminal partially expose the housing, the handle 10 is arranged at a front side of the switch device to control a movement of the movable contact, the movable contact is driven to move by turning the handle 10 to achieve that the movable contact connects or disconnects with the stationary contact, see FIG. 17.

Referring to FIG. 5 and FIG. 6, the wiring terminal comprises a connecting rod, the connecting rod partly inserts into the wiring terminal and has an interference fit with the wiring terminal, an inserting length is half of a length of the connecting rod, a lower half part of the connecting rod inserts into the wiring terminal.

Figure 7:
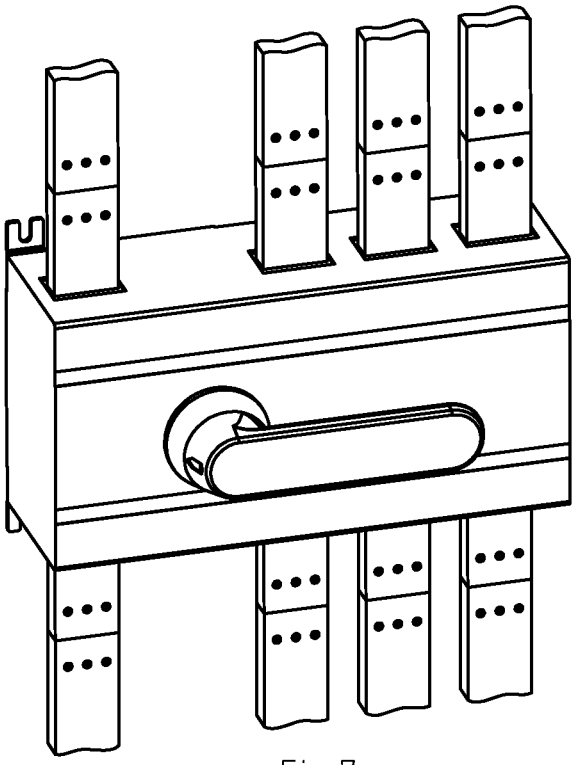
FIG. 7 is a 3d-drawing of a switch device of the invention showing from front view, wherein busbars are connected.
Figure 8:
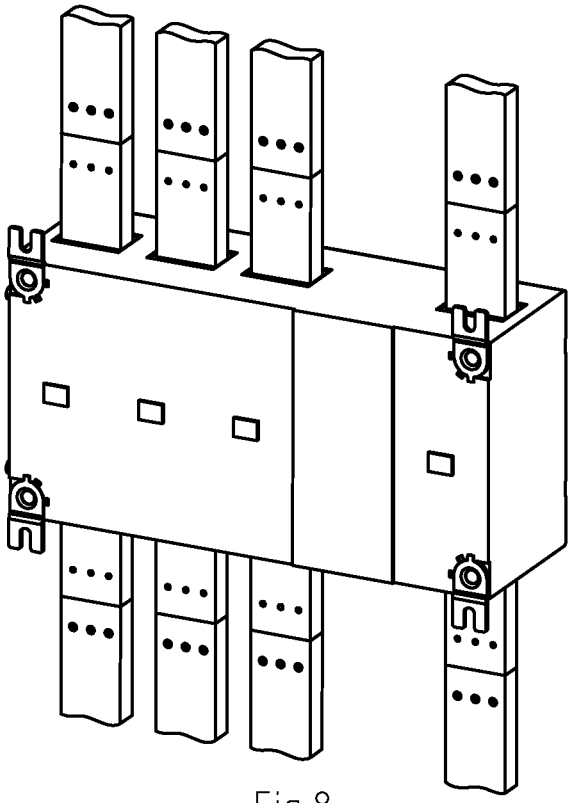
FIG. 8 is a 3d-drawing of a switch device of the invention showing from back view, wherein busbars are connected.

Referring to FIG. 7 and FIG. 8, the connecting rod of the wiring terminal inserts into a pre-hole of the busbar, an end surface 5 of the busbar fits with an end surface of the wiring terminal, the connecting rod and the busbar are tightly connected together by a pin of a front surface 3 of the busbar, such connecting manner is called butt-and-butt connecting.

Figure 9:
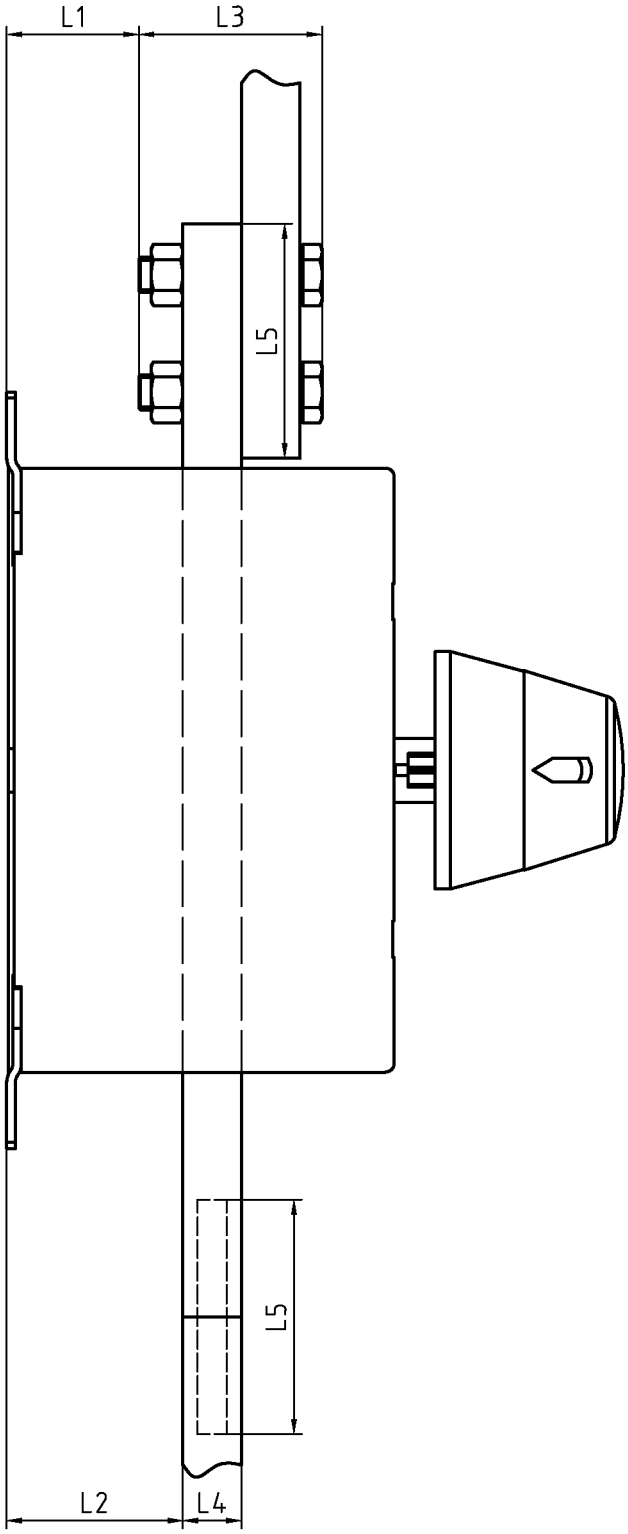
FIG. 9 is a contrast drawing of two kinds of connecting manners between the prior art and the invention.

Referring to FIG. 9, it is a contrast drawing of two connecting manners, upper half of the drawing shows an overlapping connecting between an wiring terminal of the traditional switch device and a busbar, lower half of the drawing shows a butt-and-butt connecting between a wiring terminal of the invention and a busbar, In order to highlight different effects between these two manners, the manner of the invention is directly arranged below the usual manner, each manner has the same touching length L5. As to the usual manner, L5 is a length of overlapping busbars, as to the invention, L5 is a length of a connecting rod. Intuitive differences between these two connecting manners are differences of relative dimensions, L1 is an electric clearance or safety distance of the usual manner, L2 is an electric clearance or safety distance of the invention, L3 is a width of connecting part of the usual manner, L4 is a width of connecting part of the invention.

Obviously, L2 is greater than L1, increasing amount is about a thickness of a busbar plus a rising height that a tail portion of bolt rises from a nut and plus a height of a nut. Obviously, L4 is lesser than L3, reducing amount is about a thickness of a busbar plus a height of head of a bolt plus a height of a nut and plus a rising height that a tail portion of bolt rises from a nut. Therefore, favorable factors (such as electric clearance or safety distance) for power device are increased, while unfavorable factors (such as occupation space) for power device are reduced.

Referring to FIG. 9, it is a connecting rod of the invention, the connecting rod has a column shape, and has a chamfer located at an end portion thereof convenient for assembling.

Figure 10:
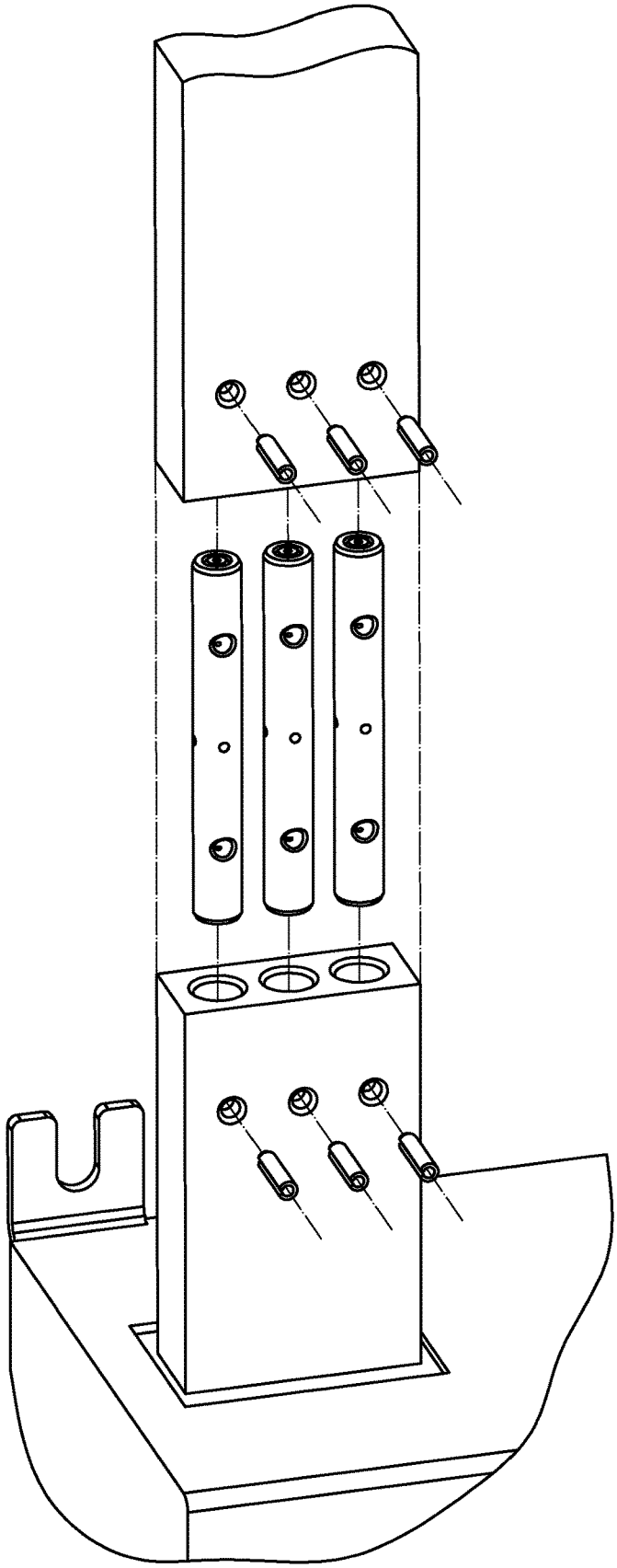
FIG. 10 is an exploded 3d-drawing of wiring terminal in FIG. 7.

Referring to FIG. 10, a first column portion 1 axially arranges a second column portion 2 which has an interference fit with the first column portion 1, the second column portion 2 is located inside of the first column portion 1. A material of the first column portion is a copper, and a material of the second column portion 2 is an aluminum.

Figure 11:
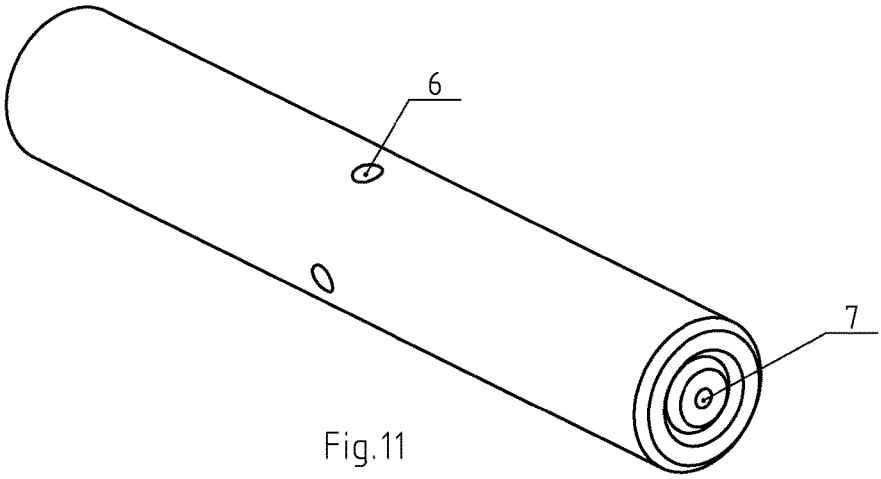
FIG. 11 is a 3d-drawing of a connecting rod of the invention.

Referring to FIG. 11, the second column portion 2 has a solid structure, and the first column portion 1 has a hollow structure, the first column portion 1 is penetrated by the second column portion 2. A ratio of an outer diameter of the second column portion 2 to the first column portion 1 is between 0.5 and 0.8. The first 1 and second 2 column portion are conductive, a thermal expansion coefficient of the second column portion 2 is greater than that of the first column portion 1, a resistivity of the second column portion 2 is greater than that of the first column portion 1.

After the connecting rod is assembled to the connecting portion 9 and a busbar, because there is an interference fit between the first column portion 1 and a pre-hole of the connecting portion 9 and of a busbar, the first column portion 1 fits closely together with the connecting portion 9 and a busbar so as to fully carry current. Because there is an interference fit between the first column portion 1 and the second column portion 2, they fit closely together with each other, the second column portion 2 also fully carries current. Therefore, thermal effect of the first 1 and second 2 column portion works well, a temperature of the second column portion 2 is greater than that of the first column portion 1, since a resistivity of the second column portion 2 is greater than that of the first column portion 1. Radial swelling of the second column portion 2 is obviously greater than that of the first column portion 1 under a condition that temperature and thermal expansion coefficient are relatively greater, since a thermal expansion coefficient of the second column portion 2 is greater than that of the first column portion 1. Therefore, the second column portion 2 fits closely together with the first column portion 1 and radially exerts an outwards force on the first column portion 1 so as to enlarge a radial dimension of the first column portion 1, finally the first column portion 1 fits more closely together with the pre-hole of the connecting portion 9 and of a busbar and simultaneously exerts a radially outwards force on the pre-hole, that is to say a pressure between the connecting rod and the connecting portion 9 and a busbar is greater now than when they begin to be assembled together, an increasing pressure thereof is good to reduce a temperature rising on a touching surface.

Thus, interference fit between elements, arrangement of resistivity and arrangement of thermal expansion coefficient are great good to reduce temperature rising on a joint of the connecting portion 9 and a busbar, these three mutually effect one another. Initial interference fit is a foundation for effects of resistivity and thermal expansion coefficient, and effects of resistivity and thermal expansion coefficient intensify the interference fit, finally a contact pressure of connecting part is enlarged.

Figure 12:
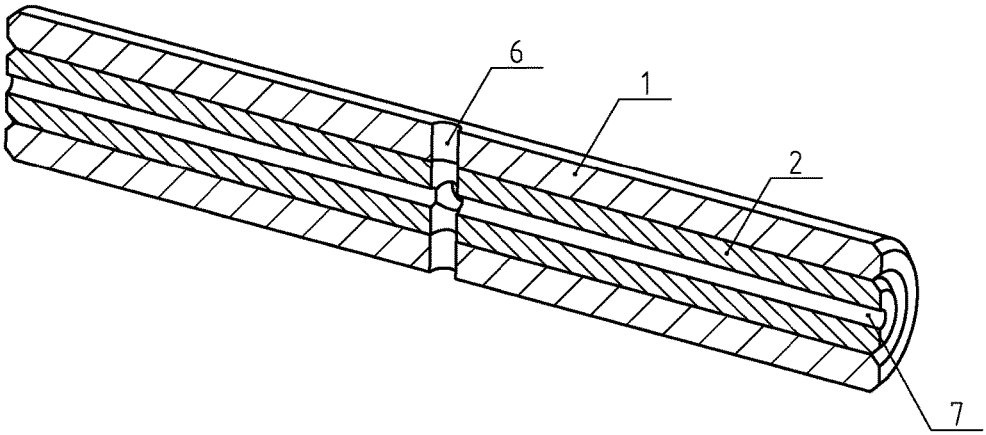
FIG. 12 is a sectional 3d-drawing of FIG. 11.

Referring to FIG. 12, a busbar with a square section has one pre-hole for receiving the connecting rod in a middle portion thereof, a distance from a periphery of the pre-hole to an edge of the busbar is R, a width of the busbar is L6.

As to a manner of overlapping busbars, a conductive area of connecting part is $$S1=L6\times L5=(R+2R+R)\times L5=4R\times L5$$

As to a manner of using connecting rod, a conductive area of connecting part is $$S2=2\pi R\times L5$$

So, $$S2:S1=2\pi R:4R=\pi/2\approx 1.57$$

Therefore, using connecting rod can reach more conductive area, obviously, under a condition of meeting requirement of mechanical strength, increasing a diameter of the pre-hole and reducing a distance from periphery of the pre-hole to an edge of the busbar or of the output can reach much more conductive area.

Figure 13:
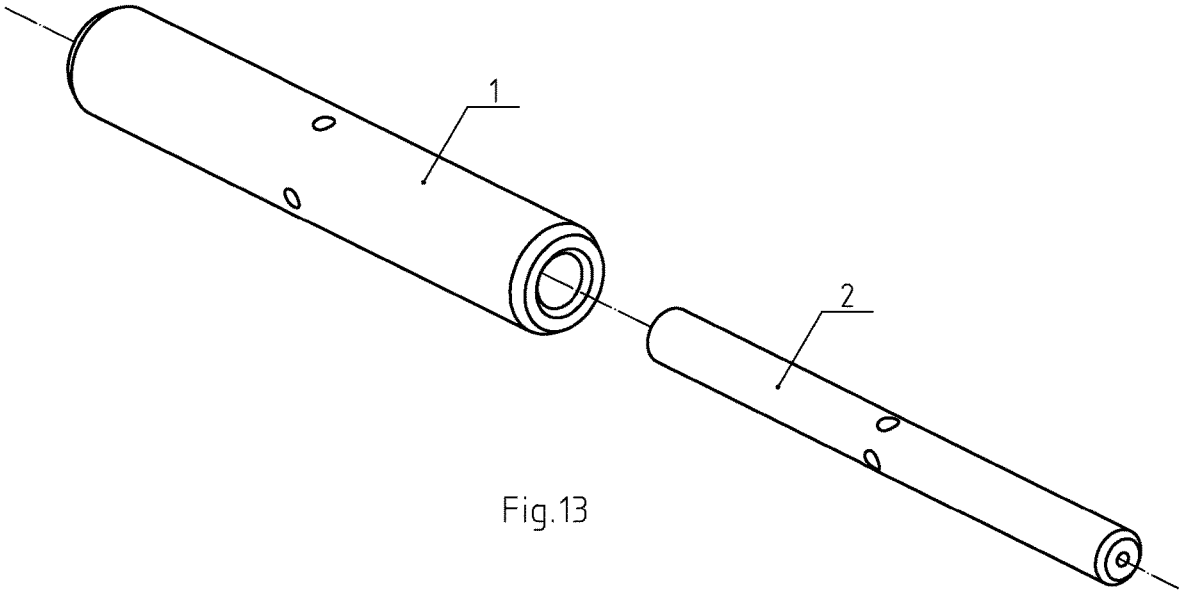
FIG. 13 is an exploded 3d-drawing of FIG. 11.

Referring to FIG. 13, a busbar with a rectangle section has three pre-holes for receiving the connecting rods in a middle portion thereof, a distance from a periphery of the pre-hole to an edge of the busbar is R, a minimum distance between neighboring pre-holes is R, a width of the busbar is L6.

As to a manner of overlapping busbars, a conductive area of connecting part is $$S1=L6\times L5=(4R+3\times 2R)\times L5=10R\times L5$$

As to a manner of using connecting rod, a conductive area of connecting part is $$S2=3\times 2\pi R\times L5=6\pi R\times L5$$

So, $$S2:S1=6\pi R:10R=3\pi/5\approx 1.884$$

Therefore, using connecting rod can reach more conductive area, obviously, under a condition of meeting requirement of mechanical strength, increasing a diameter of the pre-hole and reducing a distance from periphery of the pre-hole to an edge of the busbar or of the output can reach much more conductive area.

So the connecting rod of the invention has two positive effects, one is increasing a contact pressure, the other is greatly increasing a conductive area, reducing temperature rising on connecting parts benefits from these two positive effects, the aim of the invention is achieved.

Referring to FIG. 7, it shows an output of the invention applied to a transformer, a clamping portion 8 of the output clamps a binding post of a low-voltage-side of a transformer, then use bolts and nuts to fasten the clamping portion 8 with the low-voltage binding post. The connecting portion 9 comprises a connecting rod, which partly inserts into the connecting portion 9 and which has an interference fit with the connecting portion 9, an inserting length is half length of the connecting rod, lower half of the connecting rod inserts into the connecting portion 9, a pin located on a front surface 3 of the connecting portion 9 tightly connects the connecting rod with the connecting portion 9.

Three pre-holes for receiving the connecting rod are made to an end surface 5 of the connecting portion 9 along a length direction of the connecting portion 9 before the connecting rod is assembled to the connecting portion 9, a diameter of the pre-hole is slightly lesser than an outer diameter of the connecting rod so as to achieve a radial interference fit between the connecting rod and the pre-hole, a depth of the pre-hole is slightly greater than half of length of the connecting rod. After the pre-hole is made, half of the connecting rod inserts into the pre-hole wherein a first through hole 6 located at a middle portion of the connecting rod reaches to an end surface 5 of the connecting portion 9, a through hole for assembling a pin is made from a front surface 3 of the connecting portion 9, the through hole penetrates through the front surface 3 and a rear surface 4 of the connecting portion 9, and also penetrates through the connecting rod, an axis of the through hole intersects an axis of the connecting rod, the connecting portion 9 and the connecting rod are tightly connected together by the pin.

Three pre-holes for receiving the connecting rod are made to an end surface 5 of a busbar along a length direction of a busbar before a busbar is assembled to the connecting portion 9, a diameter of the pre-hole is slightly lesser than an outer diameter of the connecting rod so as to achieve a radial interference fit between the connecting rod and the pre-hole, a depth of the pre-hole is slightly greater than half of length of the connecting rod. After a pre-hole is made on a busbar, the pre-hole of a busbar sheathes on the connecting rod rising on the connecting portion 9 till an end surface 5 of a busbar fits with an end surface 5 of the connecting portion 9, then a through hole for assembling a pin is made from a front surface 3 of a busbar, the through hole penetrates through the front surface 3 and a rear surface 4 of a busbar, and also penetrates through the connecting rod, an axis of the through hole intersects an axis of the connecting rod, a busbar and the connecting rod are tightly connected together by the pin to finally achieve that a busbar and the connecting portion 9 are tightly connected together.

After the connecting portion 9 and a busbar are butt-and-butt connected, there is an axial clearance fit between the connecting rod and the pre-hole, this is good for fitting between end surface of the connecting portion 9 and end surface of a busbar. There is a chamfer convenient for assembling located at a head portion of a pre-hole. There is an interference fit between the pin and the hole. An axial movement between the connecting portion 9 and a busbar is limited after the pin is positioned, finally the connecting portion 9, the connecting rod, the busbar and the pin these four are be tightly connected together.

Figure 14:
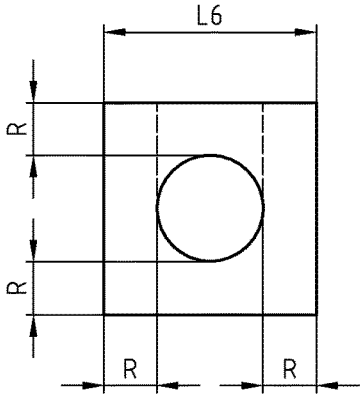
FIG. 14-15 are drawings of an arrangement of connecting rods of the invention.
Figure 15:
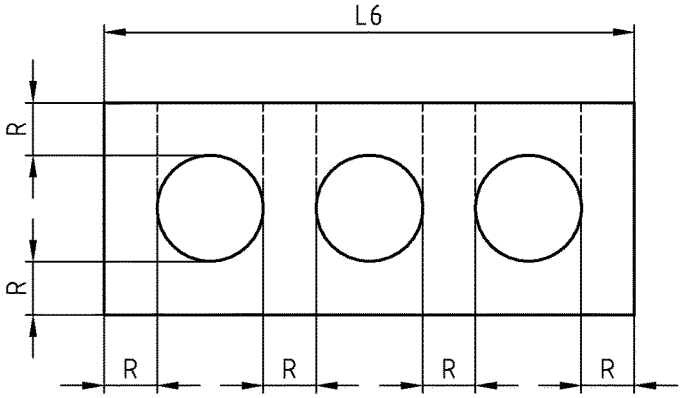
Figure 16:
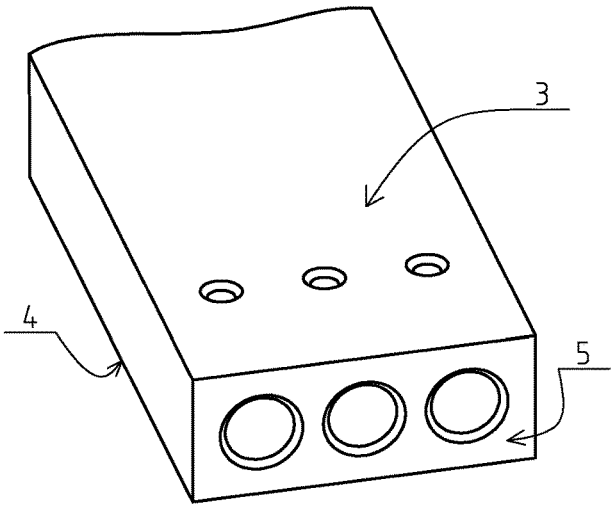
FIG. 16 is a 3d-drawing of a busbar.

Referring to FIG. 14, in order to define surfaces of a busbar and a connecting portion 9, the end surface 5 is defined by a surface bounded by a thickness and a width of a busbar (or a connecting portion 9), as showed as symbol 5 in FIG. 14. A front surface 3 and rear surface 4 are defined by a surface bounded by a width and length of a busbar (or a connecting portion 9), as showed as symbol 3,4 in FIG. 14, symbol 3 is for the front surface, and symbol 4 is for the rear surface.

Referring to FIG. 10, the second column portion 2 axially arranges a second through hole 7 located inside of the second column portion 2, the first column portion 1 has a hollow structure, the first column portion 1 is penetrated by the second column portion 2, a first through hole 6 is radially arranged to an outer cylindrical surface of the first column portion 1, the first through hole 6 is communicated with the second through hole 7, the first through hole 6 is located at a middle portion of the first column portion 1 with respect to an axial direction.

Air in the pre-hole of the connecting portion 9 freely flows out via the second through hole 7 due to such arrangement of through hole 6,7 during the connecting rod inserts into the pre-hole of the connecting portion 9, so the connecting rod is conveniently positioned. Air in the pre-hole of a busbar freely flows out from the first through hole 6 via the second through hole 7 due to such arrangement of through hole 6,7 during a busbar is assembled to the connecting rod that is already assembled to the first busbar, so a busbar is conveniently positioned.

Embodiment 2

The material of the first column portion 1 in embodiment 1 is replaced by a copper alloy, and the material of the second column portion 2 in embodiment 1 is replaced by an aluminum alloy. Since a hardness of alloy is relatively high, the second column portion 2 is kept in a low temperature (5° C.) for a period of time (5 minutes), and the first column portion 1 is kept in a high temperature (80° C.) for a period of time (5 minutes), an inner diameter of the first column portion 1 is slightly increased and an outer diameter of the second column portion 2 is slightly reduced due to thermal expansion and contraction so as to conveniently assemble the second column portion 2 into the first column portion 1, when a temperature of assembled connecting rod returns to a normal temperature, an interference fit is formed between the first 1 and second 2 column portion. There are several different kinds of diameters and lengths of the connecting rod so as to meet different size of busbars or different size of the connecting portions 9.

The invention claimed is:

1. A switch device comprises a wiring terminal for connecting a busbar, wherein the wiring terminal comprises a connecting rod, which partly inserts into the wiring terminal and has an interference fit with the wiring terminal, the connecting rod comprising a conductive first column portion (1) that has an interference fit with the busbar, the first column portion (1) axially arranging a conductive second column portion (2) that has an interference fit with the first column portion (1), the second column portion (2) being located inside of the first column portion (1), a thermal expansion coefficient of the second column portion (2) being greater than that of the first column portion (1), a resistivity of the second column portion (2) being greater than that of the first column portion (1), a material of the second column portion (2) being an aluminum or an aluminum alloy, and a material of the first column portion (1) being a copper or a copper alloy.

2. The switch device according to claim 1, wherein the switch device comprises a plurality of poles, each one of the plurality of poles comprising two wiring terminals, a switching unit being arranged between the two wiring terminals for connecting or disconnecting the two wiring terminals, the switching unit comprising a movable contact connecting with a first wiring terminal, a stationary contact connecting with a second wiring terminal, and a shell housing the movable contact and the stationary contact, the first wiring terminal and the second wiring terminal partially exposing the housing, a handle for controlling a movement of the movable contact is arranged to the switch device.

3. A switch device comprises a wiring terminal for connecting a busbar, wherein the wiring terminal comprises a connecting rod, which partly inserts into the wiring terminal and has an interference fit with the wiring terminal, the connecting rod comprising a conductive first column portion (1) that has an interference fit with the busbar, the first column portion (1) axially arranging a conductive second column portion (2) that has an interference fit with the first column portion (1), the second column portion (2) being located inside of the first column portion (1), a thermal expansion coefficient of the second column portion (2) being greater than that of the first column portion (1), a ratio of an outer diameter of the second column portion (2) to the first column portion (1) being between 0.5 and 0.8, the connecting rod axially arranging a second through hole (7) located inside of the connecting rod, a first through hole (6) being radially arranged to an outer cylindrical surface of the connecting rod, the first through hole (6) being communicated with the second through hole (7), the first through hole (6) being located at a middle portion of the connecting rod with respect to an axial direction.

4. The switch device according to claim 3, wherein the switch device comprises a plurality of poles, each one of the plurality of poles comprising two wiring terminals, a switching unit being arranged between the two wiring terminals for connecting or disconnecting the two wiring terminals, the switching unit comprising a movable contact connecting with a first wiring terminal, a stationary contact connecting with a second wiring terminal, and a shell housing the movable contact and the stationary contact, the first wiring terminal and the second wiring terminal partially exposing the housing, a handle for controlling a movement of the movable contact is arranged to the switch device.

* * * * *